US005186722A

United States Patent [19]

Cantrell et al.

[11] Patent Number: 5,186,722

[45] Date of Patent: Feb. 16, 1993

[54] HYDROCARBON-BASED FUELS FROM BIOMASS

[75] Inventors: Charles L. Cantrell; Ngee S. Chong, both of Austin, Tex.

[73] Assignee: Cantrell Research, Incorporated, Austin, Tex.

[21] Appl. No.: 720,724

[22] Filed: Jun. 25, 1991

[51] Int. Cl.[5] ..... C10M 1/04

[52] U.S. Cl. ..... 44/605; 44/905; 585/14; 585/240; 585/242; 585/355; 585/356; 585/947

[58] Field of Search ..... 585/240, 242, 355, 356, 585/947, 14; 44/605, 905

[56] References Cited

U.S. PATENT DOCUMENTS

| | | | |
|---|---|---|---|
| 1,405,809 | 2/1922 | Whitaker et al. . | |
| 2,211,432 | 8/1940 | Palmer et al. | 585/432 |
| 2,388,100 | 10/1945 | Wadley . | |
| 2,400,012 | 5/1946 | Littmann | 585/432 |
| 2,402,863 | 6/1946 | Zuidema | 44/604 |
| 2,402,898 | 6/1946 | Kirkpatrick | 260/668 |
| 2,857,439 | 10/1958 | Glasebrook | 260/668 |
| 3,270,075 | 8/1966 | Derfer et al. | 585/355 |
| 3,280,207 | 10/1966 | Liquori et al. | 585/355 |
| 3,312,635 | 4/1967 | Liquori et al. | 252/470 |
| 4,249,028 | 2/1981 | Bledsoe, Jr. et al. | 585/355 |
| 4,300,009 | 11/1981 | Haag et al. | 585/240 |
| 4,533,487 | 8/1985 | Jones | 252/170 |
| 4,548,615 | 10/1985 | Lonchamp et al. | 44/1 D |
| 4,623,363 | 11/1986 | Zaweski et al. | 44/57 |
| 4,720,603 | 1/1988 | Martin et al. | 585/431 |
| 4,818,250 | 4/1989 | Whitworth | 44/62 |
| 4,915,707 | 4/1990 | Whitworth | 44/62 |
| 4,990,712 | 2/1991 | Harandi et al. | 585/324 |
| 5,004,850 | 4/1991 | Wilson | 585/1 |

FOREIGN PATENT DOCUMENTS 0077289A 4/1983 European Pat. Off. .

OTHER PUBLICATIONS

Tanaka et al., "Hydrogenation and dehydrogenation of 4-isopropenyl-1-methylcyclo-hexene catalyzed by MgO, CaO, $La_2O_3$, $ThO_2$, and $ZrO_2$," Bulletin of the Chem. Soc. Japan, 51 (12):3411-3746, 1978.

Dialog Search Report Abstracts.

*Primary Examiner*—Jacqueline Howard

*Attorney, Agent, or Firm*—Arnold, White & Durkee

[57] ABSTRACT

The invention relates to a process for providing fuels from biomass such as seed oils or plant fruits. Generally the process utilizes a metal catalyzed conversion to step to provide fuel mixtures with compositions that may be varied depending on conditions of temperature, pressure and time of reaction. Mixtures of hydrocarbons produced from limonene feedstocks include alicyclic, alkyl and aromatic species. Monocyclic aromatic compounds may be obtained in high yields depending on the reaction conditions employed.

29 Claims, 4 Drawing Sheets

HYDROCARBON-BASED FUELS FROM BIOMASS

BACKGROUND OF THE INVENTION

1. Field of the Invention

The invention relates generally to biomass fuels derived from plant sources. In particular aspects, the invention relates to a terpenoid-based fuel produced by a cracking/reduction process or by irradiation. The process may be controlled to produce a biomass fuel having variable percentages of benzenoid compounds useful, for example, as per se fuels, as fuel additives or as octane enhancers for conventional gasoline fuels.

2. Description of the Related Art

Increasing attention is being focused on problems associated with diminishing supplies of fossil fuels. These problems center on economic and ecologic considerations. It is recognized that oil and gas sources are exhaustible and that world politics may seriously jeopardize attempts to manage presently identified petroleum reserves. These are strong economic factors having potential effects on many facets of business and quality of life. There is also increasing concern over the pollution generated by fossil fuel burning which causes extensive and perhaps irreversible ecological harm. Consequently, fuel performance is becoming more of a concern, since highly efficient fuels, especially for internal combustion engines, will decrease or eliminate toxic emissions and cut operation costs.

Approaches to these problems have included efforts to develop total substitutes or compatible blends for petroleum-based fuels. For example, engines will operate efficiently on natural gas or alcohol. However, this requires engine modifications that are relatively expensive and at the present considered impractical in view of present production and sheer numbers of extant engines. With pure methanol, corrosion, particularly evident in upper-cylinder wear may be a problem (Schwartz, 1986).

Biomass sources have been explored as fuel source alternatives to petroleum. Biomass is defined as organic matter obtained from agriculture or agriculture products. Many side-products of foods, for example, are inefficiently used, leading to large amounts of organic waste. Use of such waste as a fuel per se or as a blend compatible with existing petroleum based fuels could extend limited petroleum reserves, reduce organic waste and, depending on the processing of the organic waste, provide a less expensive alternate fuel or fuel blends.

One of the more common components of plants and seeds is a group of alicyclic hydrocarbons classified as terpenes. Pinene and limonene are typical examples of monocyclic terpenes. Both have been tested as fuels or fuel additives. The Whitaker reference (1922) discloses the use of a terpene, as a blending agent for alcohol and gasoline or kerosene mixtures. A fuel containing up to about 15% of steam distilled pine oil was claimed to be useful as a motor fuel. Nevertheless, pinene was useful mainly to promote soluble mixtures of ethyl alcohol, kerosene and gasoline. There were no disclosed effects on fuel properties nor was there disclosed any further processing of the pinene.

Two United States patents describe a process for purifying limonene for use as a fuel or fuel additive (Whitworth, 1989, 1990). The process includes distillation of limonene-containing oil followed by removal of water. The distilled limonene, blended with an oxidation inhibitor such as p-phenylenediamine, is claimed as a gasoline extender when added in amounts up to 20% volume. Unfortunately, in actual testing under a power load in a dynamometer, addition of 20% limonene to unleaded 87 octane gasoline results in serious preignition, casting serious questions as to its practical value as a gasoline extender.

On the other hand, Zuidema (1946) discloses the use of alicyclic olefins such as limonene, cyclohexene, cyclopentene and menthenes without modification as stabilization additives for gasoline. These compounds contain at least one double bond, a characteristic that apparently contributes to the antioxidant effect of adding these compounds to gasolines in amounts not exceeding 10% by volume.

U.S. Pat. No. 4,300,009 (Haag, 1981) is concerned with the conversion of biological materials to liquid fuels. Although relating in major part to zeolite catalytic conversion of plant hydrocarbons having weights over 150, a limonene/water feed was shown to produce about 19% toluene when pumped over a fixed bed zeolite catalyst at 482° C. at atmospheric pressure. Unfortunately, monocyclic aromatic compounds were reported to comprise only about 40% of the total products, of which major components were toluene and ethylbenzene. A disadvantage with the use of zeolite catalyst was the need to fractionate the aromatic compounds from the product mixture to obtain gasoline or products useful as chemicals. Formation of undesirable coke was also disclosed as a potential problem, in view of its tendency to inactivate zeolite catalysts.

Biomass fuel extenders such as methyltetrahydrofuran (MTHF) have been tested as alternative fuels (Rudolph and Thomas, 1988), but appear to be relatively expensive as pure fuels. As an additive in amounts up to about 10%, MTHF compares favorably with tetraethyl lead.

Fuel mixtures suitable as gasoline substitutes have also been prepared by mixing various components, for example $C_2$–$C_7$ hydrocarbons, $C_4$–$C_{12}$ hydrocarbons and toluene (Wilson, 1991). Toluene, and other substituted monocyclic benzenoid compounds such as 1,3,5-trimethylbenzene, 1,2,3,4-tetramethylbenzene, o-, m- and p-xylenes, are particularly desirable as octane enhancers in gasolines and may be used to supplement gasolines in fairly large percentages, at least up to 40 or 50 percent.

Generally, processes for obtaining aromatic compounds are synthetic procedures. Therefore it is relatively expensive to use aromatic liquid hydrocarbons as fuels or blends for gasoline fuels. On the other hand, a biomass source of easily isolated aromatic compounds would be less expensive, provide an efficient disposal of organic waste, and conserve petroleum reserves by extending or possibly replacing gasoline fuels. Although aromatic hydrocarbons occur naturally and are isolable from plant sources, it is impractical to isolate these compounds from biomass material because of the relatively low amounts present.

SUMMARY OF THE INVENTION

The present invention is intended to address one or more of the problems associated with dependence on fuels obtained from petroleum sources. The invention generally relates to a process of preparing hydrocarbon-based fuels from available plant components containing terpenoids. The process involves catalytic conversion of one or more terpenoid compounds under conditions that may be varied to alter the product or products produced. Such products are generally mixtures of hydrocarbons useful as fuels per se or as fuel components.

The inventors have surprisingly discovered that biomass fuels may be appreciably improved through the application of catalytic conversion process techniques, heretofore utilized in cracking methods of processing petroleum crudes and related complex mixtures of petroleum fuels. Unexpectedly, it was also found that biomass fuels may under certain conditions be converted in exceptionally high yield to aromatic hydrocarbons comprising mixtures with significant octane boosting properties.

In one aspect, the invention involves a process for the preparation of a biomass fuel that includes conversion of a suitable feedstock by metal catalysis at an elevated temperature to a mixture of hydrocarbons, then obtaining the biomass fuel from the resulting hydrocarbon mixture. The isolated product or products will be derivatives or molecularly rearranged species of the feedstock material which itself may be obtained from a wide range of biomass sources.

Such a feedstock will typically include one or more terpenoid class compounds, preferably as a major component. This is commonly the case in many plants, especially in plant seeds or in parts of plants that have a high oil content, such as skins of citrus fruits or leaves. Numerous plant source oils are suitable including a variety of fruits, particularly citrus fruits, vegetables and agriculture products such as corn, wheat, eucalyptus, pine needles, lemon grass, peppermint, lavender, milkweed, tallow beans and other similar crops. Examples of terpenoid compounds found in leaves, seeds and other plant parts include $\alpha$-pinenes, limonenes, menthols, linalools, terpinenes, camphenes and carenes, for example, which may be monounsaturated or more highly unsaturated. Preferred feedstock terpenoids are monocyclic. Limonenes are particularly preferable since they are found in high quantity in many plant oils. Limonene is useful in the optically inactive DL form or as the D or L isomer.

Feedstocks are generally more conveniently processed in liquid rather than solid form. Therefore, plant sources of terpenoids are usually extracted or crushed to obtain light or heavy oils. A particularly suitable oil is derived from citrus fruit, such as oranges, grapefruits or lemons. These oils are high in limonene content. Limonene feedstock oils, or for that matter any appropriate feedstock oil, need not be mixed with solvents and are conveniently directly catalytically converted and/or irradiated to provide hydrocarbon fuel mixtures.

In certain aspects, biomass-derived feedstocks are processed by metal catalyst conversion. Conversion is typically conducted at elevated temperatures in the range of 80° C. up to about 450° C., preferably between about 90° C. to 375° C. using limonene feedstock and most preferably in an inert atmosphere when high yields of monocyclic aromatic compounds are desired. When both a suitable catalyst and hydrogen are present, the catalytic conversion process leads to molecular rearrangements and hydrogenation, including intramolecular dehydrogenation ring cleavage and scission of carbon bonds.

Pressures may range from atmospheric to elevated pressures, e.g., up to 2,000 psi or above. The pressures employed determine the major products in the mixture as well as the overall mixture composition of hydrocarbons obtained. In general it has been found that pressures from atmospheric up to about 500 psi result in production of monocyclic aromatic compounds as the major product. At higher pressures, aromatic species are usually not present and major products are fully reduced alicyclic products. In general it has been found that variations in temperature, pressure and time of reaction will affect product ratio and distribution. For example, when an inert gas is used to sparge the reaction mixture and pressures are close to atmospheric, 1-methyl-4-(1-methylethyl)benzene (p-cymene) is obtained in yields close to 85%.

Catalysts employed in the process are typically hydrogenation catalysts. These may include barium promoted copper chromate, Raney nickel, palladium, platinum, rhodium and the like. In a preferred embodiment, a noble metal catalyst such as 1%–5% palladium on activated carbon is effective. However, it will be appreciated that there are other types of catalysts that might be used in this process including mixed metal, metal-containing zeolites or oganometallics. In some instances, it may be preferable to use alternate sources of hydrogen. Water or alcohols, for example, could be used as hydrogen sources.

After the catalytic conversion step, the catalyst is removed from the product mixture. In cases where a palladium on carbon catalyst is used, this is merely a matter of removing the catalyst by filtration or by decantation. Most catalysts may be regenerated or reused directly. As an optional step, an inert gas or hydrogen may be passed through the product mixture. This discourages product oxidation, especially when unsaturated compounds are present that are unusually susceptible to air oxidation. Furthermore, when high yields of monocyclic aromatic compounds are desired, as when limonene feedstock is employed, an inert gas bubbled or sparged through the reaction mixture improves yields. Nitrogen gas is preferred but other gases such as argon, xenon, helium, etc., could be used.

Reactions may be conducted on-line rather than in reactor vessels. Reaction rates and product formation would be adjusted by flow rates as well as parameters of pressure and temperature.

In usual practice, products obtained from the catalytic conversion process are distilled and may be collected over wide or narrow temperature ranges. Typically, a distillate is collected between 90° and 230° C. (as measured at atmospheric pressure). In a preferred embodiment, the distillate from a metal catalyzed conversion of limonene is collected between 90° and 180° C. The composition of this mixture will vary somewhat depending on the conditions under which the reaction is conducted; however, in general, the product mixture will include 2–3 major hydrocarbon components which may be mixed with conventional fuels such as gasoline or used without additional components as a fuel. Some of the components of the mixture, particularly aromatic species when present, may be further processed to isolate individual compounds.

Limonene is typically the major component of feedstocks from citrus oils. Under one set of selected conditions, that is, processing at 415° C., 1200 psi using a 5% palladium on carbon catalyst, the major components of the collected product are cis and trans, 1methyl-4-(1-methylethyl) cyclohexane. Varying amounts of minor components may also be present, including hexane, 3,3,5-trimethylheptane, 1,1,5-dimethylhexyl-4-methyl-cyclohexane, m-methane and 3,7,7-trimethylbicyclo-4.1.0 heptane. Minor components are typically less than 5%, and more usually, 1% or less.

Biomass fuel products produced by other variations of the process described may be obtained when lower pressures are used, that is, pressures less than 500 psi or under normal atmospheric conditions. In a run at 500 psi for example, the major products are cis and trans 1-methyl-4-(1-methylethylidine) cyclohexane and 1-methyl-4-(1-methylethyl) benzene. Minor components from this reaction typically include 1-methyl-4-(1-methylethyl) cyclohexene, limonene, hexane, 3,3-dimethyloctane, 2,4-dimethyl-1-heptanol, dodecane, 3-methyl nonane and 3,4-dimethyl-1-decene. Minor products will tend to vary arising, for example, from contaminants in the feedstock or from air oxidation of primary products.

In a most preferred embodiment, limonene feedstock is heated to about 110° C. at atmospheric pressure under an inert atmosphere such as nitrogen. The inert gas is bubbled or sparged through the reaction mixture during the heating process. Under these conditions, the major product, often in excess of 84%, is 1-methyl- 4-(1-methylethyl)benzene. Total minor products make up less than 1% of the product composition. The product, usually isolated by distillation, may be used directly as an octane-enhancer, as a fuel or in nonfuel applications, such as a solvent.

In another aspect of the invention, the biomass feedstock is irradiated and additionally subjected to catalytic conversion in the presence of hydrogen. The irradiation is preferably conducted with ultraviolet light in a wavelength range of 230 to 350 nanometers. In preferred practice, the irradiation is performed concurrently with catalytic conversion. The effect of the irradiation is to modify product distribution, most likely by the creation of free radicals which cause a variety of intramolecular rearrangements. Product distribution therefore may be different from the distribution obtained using only catalytic conversion. Generally used methods of irradiation include use of lamps with limited wavelength range in the ultraviolet or lamps with appropriate filters, for example 450 watt tungsten lamps with ultraviolet selective sleeves. The ultraviolet light may be directed toward a feedstock or aimed at the vapor of the reaction mixture under reflux conditions. Biomass fuel mixtures obtained from the combined irradiation/catalytic conversion typically produces mixtures in which the major components are cis and trans-1-methyl-4-(1-methylethyl) cyclohexane and 1-methyl-1-(4-methylethyl) benzene. Minor components in these mixtures are typically 3,3,5-trimethylheptane, 2,6,10,15-tetramethylheptadecane, 3-methylhexadecane, 3-methyl nonane and $\beta$-4-dimethylcyclohexane ethanol. A preferred catalyst is palladium on activated carbon; however, other catalysts such as platinum, rhodium, iron, barium chromate and the like may be used.

In yet another aspect, the invention is directed to hydrocarbon mixtures such as obtained by the above described processes. Under selected conditions of reaction with a predominantly limonene feedstock, for example 500 psi, the product mixture will be chiefly hydrocarbons having formulas typically $C_{10}H_{14}$, $C_{10}H_{18}$, and $C_{10}C_{20}$. Under the particular conditions used in a preferred embodiment, that is, temperature of 260° C., atmospheric pressure and a limonene feedstock, products typically include 1-methyl-4-(1-methylethyl) benzene, 1-methyl-4-(1-methylethylidene) cyclohexene, and 1-methyl-4-(1-methylethyl) cyclohexane and are typically obtained in a ratio of about 50:9:41. This mixture in combination with traditional gasoline fuels, for example, 87 octane gasoline, will boost octane when added in relatively low percentages. It may also be added to gasoline in amounts of 25% of total volume without detrimentally effecting engine performance. The $C_{10}H_{20}$ component of the mixture is a substituted cyclohexane and has been identified as having the formula 1-methyl-4-(1-methylethyl) cyclohexane, in cis and trans forms. The $C_{10}H_{14}$ major components are substituted benzenoid compounds typically having the structure 1-methyl-4-(1-methylethyl) benzene, although other substituted benzenes may be obtained depending on the conditions under which the process is conducted. The $C_{10}H_{18}$ component is typically a substituted cyclo-olefin, such as 1-methyl-4-(1-methylethylidene) cyclohexene.

In yet another aspect of the invention the biomass fuel produced by one or more of the foregoing processes may be used to increase octane and reduce emissions when blended with conventional gasolines and used in an internal combustion engine. The hydrocarbons or hydrocarbon mixture produced by the process combine with petroleum fuels, gasoline or diesel, for example, and may be used in amounts up to at least 25% by volume. Additionally, the hydrocarbon mixture or biomass product may be used alone to operate an internal combustion engine.

In still another aspect of the invention, an engine may be operated by supplying it with a hydrocarbon mixture produced by the process described. Purified limonene feedstocks, for example, when subjected to catalytic conversion at temperatures near 105° C. and ambient pressure produce products composed mainly of monocyclic aromatic compounds. By varying the reaction conditions, for example, increasing pressure or increasing the temperature, 1-methyl-4-(1-methylethyl) benzene is produced in yields of 30 to 84%. These various mixtures may be used directly or mixed in various amounts with gasoline, thus providing fuels which may be used to operate a combustion engine, for example an automobile engine.

DETAILED DESCRIPTION OF PREFERRED EMBODIMENTS

Figure 1A:
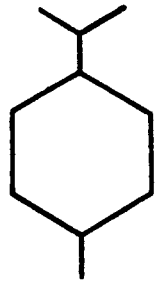
FIG. 1(*a–f*) shows the structures of some of the hydrocarbons produced by cracking/hydrogenation of limonene.
Figure 1B:
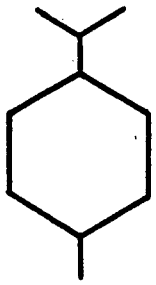
Figure 1C:
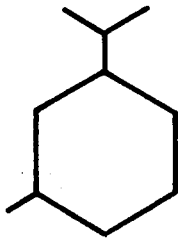
Figure 1D:
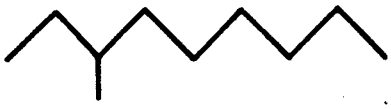
Figure 1E:
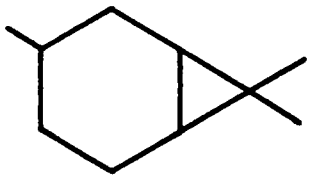
Figure 1F:
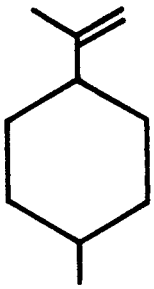

This invention concerns a novel process for producing various hydrocarbon fuels from biomass feedstocks, typically plant extracts. Feedstocks are obtainable from a wide variety of plant sources such as citrus peels or seeds of most plant species. Oils are preferred as they have a high terpenoid content. Simple extraction methods are suitable, including use of presses or distillations from pulp material. Table 1 provides an illustrative list of plant sources for terpenoids and related compounds, including species and description of specific parts. While the list may appear extensive, it will be appreciated that biomass sources are ubiquitous and range from common agricultural products such as oranges to more exotic sources such as tropical plants.

TABLE 1

BOTANICAL LIST

Plant Oils Consisting of Terpenes or Terpene-derived Chemical Components Useful as Fuel Additives

| Plant Name | Botanical Species | Chemical Components |
|---|---|---|
| Angelica | *Angelica archangelica* L. | phellandrene, valeric acid |
| Anise | *Pimpinella anisum* L. | anethole, methylchavicol, anisaldehyde |
| Asarum | *Asarum canadense* L. | pinene, methyleugenol, borneol, linalool |
| Balm | *Malissa officinalis* L. | citral |
| Basil | *Ocimum basilicum* L. | methylchavicol, eucalyptol, linalool, estragol |
| Bay or Myrcia | *Pimenta acris* Kostel. | eugenol, myrcene, chavicol, methyleugenol, methylchavicol, citral, phellandrene |
| Bergamot | *Citrus aurantium* L. (*bergamia*) | linalyl acetate, linalool, limonene, dipentene, bergaptene |
| Bitter orange | *Citrus aurantium* L. (Rutaceae) | limonene, citral, decyl aldehyde, methyl anthranilate, linalool, terpineol |
| Cajeput | *Melaleuca leucadendron* L. | eucalyptol (cineol), pinene, terpineol, valeric/butryic/benzoic aldehydes |
| Calamus | *Acorus calamus* L. (Araceae) | asarone, calamene, calamol, camphene, pinene, asaronaldehyde |
| Camphor | *Cinnamomum pamphora* T. | safrol, camphor, terpineol, eugenol, cineol, pinene, phellandrene, cadinene |
| Caraway | *Carum carvi* L. (Umbelliferae) | cavone, limonene |
| Cardamom | *Elettaria cardamomum* Maton | eucalyptol, sabinene, terpineol, borneol, limonene, terpinene, 1-terpinene, 1-terpinene-4-ol |
| Cedar | *Thuja occidentalis* L. | pinene, thujone, fenchone |
| Celery | *Apium graveolens* L. | limonene, phenols, sedanolide, sedanoic acid |
| Chenopodlum | *Chenopodlum ambrosioides* L. | ascaridole, cymene, terpinene, limonene, methadiene |
| Cinnamon | *Cinnamomum cassia* Nees | cinnamaldehyde, cinnamyl acetate, eugenol |
| Citronella | *Cymbopogon nardus* L. | geraniol, citronellal, capmhene, dipentene, linalool, borneol |
| Copalba | *Copalba balsam* | caryophyllene, cadinene |
| Coriander | *Coriandrum sativum* L. | linalool, linalyl acetate |
| Cubeb | *Piper cubeba* L. | dipentene, cadinene, cubeb camphor |
| Cumin | *Cuminum cyminum* L. | cuminaldehyde, cymene, pinene, dipentene |
| Cypress | *Cupressus sempervirens* L. | furfural, pinene, camphene, cymene, terpineol, cadinene, cypress camphor |
| Dill | *Anethum graveolens* L. | carvone, limonene, phellandrene |
| Dwarf pine needle | *Pinus montana* Mill | pinene, phellandrene, sylvestrene, dipentene, cadinene, bornyl acetate |
| Eucalyptus | *Eucalyptus globulus* | pinene, phellandrene, terpineol, citronellal, geranyl acetate, eudesmol, piperitone |
| Fennel | *Foeniculum vulgare* Mill | anethole, fenchone, pinene, limonene, dipentene, phellandrene |
| Fir | *Abies alba* Mill | pinene, limonene, bornyl acetate |
| Fleabane | *Conyza canadensis* L. | limonene, aldehydes |
| Geranium | *Pelargonium odoratissimum* Ait. | geraniol esters, citronellol, linalool |
| Ginger | *Zingiber officinaie* Roscoe | Zingiberene, camphene, phellandrene, borneol, cineol, citral |
| Hops | *Humulus lupulus* L. | humulene, terpenes |
| Hyssop | *Hyssopus officinalis* L. | pinene, sesquiter penes |
| Juniper | *Juniperus communis* L. | pinene, cadinene, camphene, terpineol, juniper camphor |
| Lavender | *Lavandula officinalis* Chaix | linalyl esters, linalool, pinene, limonen, geaniol, cineol |
| Lemon | *Citrus limonum* L. | limonene, terpinene, phellandrene, pinene, citral, citronellal, geranyl acetate |
| Lemon grass | *Cymbopogon citratus* | citral, methylheptenone, citronellal, geraniol, limonene, dipentene |
| Levant wormseed | *Artemisia maritima* | eucalyptol |
| Linaloe | *Bursera delpechiana* | linalool, geraniol, methylheptenone |
| Marjoram | *Origanum marjorana* L. | terpenes, terpinene, terpineol |
| Myrtle | *Myrtus communis* L. | pinene, eucalyptol, dipentene, camphor |
| Niaouli | *Melaleuca viridiflora* | cineol, terpineol, limonene, pinene |
| Nutmeg | *Myristica fragrans* Houtt | camphene, pinene, dipentene, borneol, terpineol, geraniol, safrol, myristicin |
| Orange | *Citrus aurantium* | limonene, citral, decyl aldehyde, methyl anthranilate, linalool, terpineol |
| Origanum | *Origanum vulgare* L. | carvacrol, terpenes |
| Parsley | *Petroselinum hortense* | apiol, terpene, pinene |
| Patchouli | *Pogostemon cablin* | patchoulene, azulene, eugenol, sesquiterpenes |
| Pennyroyal | *Hedeoma pulegioides* | pulegone, ketones, carboxylic acids |
| Peppermint | *mentha piperita* L. | menthol, menthyl esters, menthone, pinene, limonene, cadinene, phellandrene |
| Pettigrain | *Citrus vulgaris* Risso | linalyl acetate, geraniol, geranyl acetate, limonene |
| Pimento | *Pimenta officinalis* Lindl. | eugenol, sesquiterpene |
| Pine needle | *Pinus sylvestris* L. | dipentene, pinene, sylvestrene, cadinene, bornyl acetate |
| Rosemary | *Rosmarinus officinalis* L. | borneol, bornyl esters, camphor, eucalyptol, pinene, camphene |
| Santal | *Santalum album* L. | santalol |
| Sassafras | *Sassafras albidum* | safral, eugenol, pinene, phellandrene, sesquiterpene, camphor |
| Savin | *Juniperus sabina* L. | sabinol, sabinyl acetate, cadinene, pinene |
| Spike | *Lavandula spica* L. | eucalyptol, camphor, linalool, borneol, terpineol, camphene, sesquiterpene |
| Sweet bay | *Laurus nobilis* L. | eucalyptol, eugenol, methyl chavicol, pinene, isobutyric/isovaleric acids |
| Tansy | *Tanacetum vulgare* L. | thujone, borneol, camphor |
| Thyme | *Thymus vulgaris* L. | thymol, carvacrol, cymene, pinene, linalool, bornyl acetate |
| Valerian | *Valeriana officinalis* L. | bornyl esters, pinene, camphene, limonene |
| Vetiver | *Vetiveria zizanioides* | vetivones, vetivenols, vetivenic acid, vetivene, palmitic acid, benzoic acid |
| White cedar | *Thuja occidentalis* L. | thujone, fenchone, pinene |
| Wormwood | *Artemisia absinthium* L. | thujyl alcohol, thujyl acetate, thujone, phellandrene, cadinene |
| Yarrow | *Achillea millefolium* L. | cineol |

The invention has been illustrated with purified limonene but purification of biomass feedstock should not be critical in that the inventors have found that crude plant oil extracts, for example, may be used as feedstocks. The presence of other hydrocarbons and hydrocarbon derivatives may alter products and product ratios to some extent depending on the composition of feedstock and processing conditions; however, where alicyclic compounds are initially present as major components, the disclosed process is expected to provide hydrocarbon mixtures analogous to those obtained with limonene feedstocks.

The high yield of a substituted benzene from the catalytic conversion of limonene is an unexpected result. The disclosed process therefore offers a plant source for high yield of aromatic hydrocarbons and a method to convert plant hydrocarbons directly to fuel or fuel additive products.

The inventors have recognized that the carbonaceous compounds predominating in many biomass sources up until now have been of limited use as practical fuels, i.e., gasolines and the like, unless modified to render compatible with existing fuels. Ideally, fuel compatibles should improve fuel properties. The relatively simple disclosed process provides mixtures of hydrocarbon-type compounds that are gasoline fuel compatible and also improve fuel properties. The mixtures can be separated into individual components, e.g., by fractional distillation, or used in cuts as fuels per se or fuel additives.

The biomass fuel source may be any one or more of several sources. Preliminary treatment may involve crushing, pressing, squeezing or grinding the biomass to a sufficiently liquid state so that effective contact with a catalyst is possible. Orange peels, used as a source of limonene by the inventors, can be ground, then pressed with roller presses under relatively high pressure, e.g., up to 10,000 psi, to obtain an oil that is 60–70% limonene. As a practical matter, it is not necessary to purify or dry such a crude oil before processing. The inventors did in fact purify crude limonene from orange oil by a distillation process, but on a large scale and in economic terms, separation or removal of undesired components is more efficiently performed after obtaining a product mixture. The presence of small amounts of nonhydrocarbons, heterocyclic compounds and inorganic material generally has little effect on product performance or may be easily removed from the final product.

Feedstock, or in simple terms, the starting material, is catalytically converted to product. The process bears some similarity to cracking, although generally lower temperatures are used and no additives such as water need be included. Although "cracking" has long been used in the petroleum industry to "break up" heavy petroleum crudes such as sludges and heavy oils, the inventors have found that a similar process may be applied to simple plant-derived hydrocarbons to produce novel fuel components. Cracking as generally employed in the petroleum industry, involves heating heavy crudes at relatively high temperatures, often in the presence of a catalyst. Depending on the nature of the catalyst, the length of time of heating, temperature, pressure, etc., various molecular rearrangements occur, including breaking of bonds, isomerizations and cyclizations, leading frequently to lower molecular weight products.

While variations of cracking are routinely considered for processing of petroleum crudes, the inventors have discovered that when cracking methods are used on a single component, a mixture of reaction products is obtained which unexpectedly enhance gasoline octane and/or act as a fuel extender. This is somewhat surprising since products resulting from heating limonene, for example, in the presence of a catalyst are not much different in molecular weight from the starting material. Thus when limonene is heated to about 370° C. in the presence of a metal catalyst the consequence is broken bonds, rearranged double bonds, and, when hydrogen is present, reduction of unsaturated compounds. At lower temperatures, e.g., 105° C., predominating products appear to arise from rearrangements rather than bond scission. At lower temperatures, an aromatic ring compound, a benzene derivative is commonly the main product from catalytic conversion of limonene. It is likely that this mononuclear aromatic species results from some mechanism that isomerizes the external double bond of limonene into the ring, then dehydrogenates to fully aromatize the ring. In any event, the reaction process has been shown to give efficient production of 1-methyl-4-(1-methylethyl) benzene from limonene with yields exceeding 84% achieved in a single step process.

There are many ways one could run the reaction that converts limonene, or other like compounds or mixtures, to compounds that make useful fuels or fuel additives. The process is essentially a single-step operation. As one example, one simply places limonene in a suitable vessel, adds a catalyst such as platinum or palladium on carbon, then heats the oil to about 90°–180° C. An inert gas or, alternatively, hydrogen may be passed through the mixture. The reaction is monitored over some period of time, e.g., about two hours for reactions on the scale of about 2 liters and depending on the amount of catalyst, size of vessel, etc. Monitoring by gas chromatography, for example, is by withdrawing some liquid from the reaction vessel and injecting directly onto the column of a gas chromatograph. When desirable compounds have formed, the reaction may be terminated. This is done by removing the hydrogen source if hydrogen is used, cooling the oil, filtering off the catalyst, if necessary, and then purifying any product desired.

Products are generally isolated by distillation which is rapid and simple. It may be done from the same process vessel as the catalytic conversion, thus utilizing a batch process. If this route is taken, catalyst should be removed as it might explode or catch fire if hydrogen gas is adsorbed on its surface, as is the case with platinum on carbon. But catalysts that are readily removed may be used, for example, an immobilized catalyst which is lifted from the reaction vessel. In any event, the product is generally a liquid which may be fractionally distilled into single or mixtures of products based on relative boiling points.

The following is a description of the analytical methods used including the dynamometer and test engine set up for determining fuel properties.

Chromatography

Gas chromatography was conducted using a Hewlett-Packard 5890 Series II gas chromatograph equipped with a Hewlett-Packard Vectra 386/25 for data acquisition; gas chromatography/mass spectrometry was performed using a Hewlett-Packard 5971A MSD with a DB wax 0.25 mm i.d. 1 μ capillary column.

Dynamometer

The dynamometer used for testing was purchased from Super Flo (Colorado Springs, Colo.), model SF 901 with a full computer package which included a Hewlett-Packard model Vectra ES computer. Standard heat exchangers were added. Data were recorded using a HP model 7475A X-Y plotter.

Test Engine

The test engine was constructed from high nickel alloy Bowtie blocks (General Motors, Detroit, Mich.) with stainless steel billet main caps, block machined to parallel and square to the main bearing bore with dimensions set and honed with a torque plate. Tolerances were 0.0001 inch on the cylinder diameters and tapers. Pistons, purchased from J & E (Cordova, Calif.) were machined to a wall tolerance of 0.003 inch. Pistons and connecting rod pins were fit to a tolerance of 0.0013 inch. The pistons were lined up in the deck blocks (9" in depth) at zero deck. Bottom assembly was blueprinted to tolerances of 0.0001 inch.

The engine was an 8-cylinder Pontiac with raised port cylinder heads. These were ported, polished and flowed by Racing Induction Systems (Connover, N.C.) for even fuel distribution. Camshafts were tested for 1850–7200 rpms at 106° intake centerline to 108° intake center line.

The examples which follow are intended to illustrate the practice of the present invention and are not intended to be limiting. Although the invention is demonstrated with highly purified limonene feedstocks, the starting material used in the disclosed process is not necessarily limited to a single compound, or even to terpenoid compounds. A wide range of hydrocarbon feedstocks could be used, including waste hydrocarbons from industrial processes. One value of the process lies in the potential to utilize biomass sources, often considered waste products, in providing fuels from sources independent of petroleum interests.

Many variations in experimental conditions are possible, leading to numerous product combinations. Differences in temperature and pressure (compare Examples 1, 2, 4 and 5) will determine the type and yield of products obtained.

EXAMPLE 1

Catalytic Conversion of Limonene to Aromatic-Rich Product (Method A)

Figure 2A:
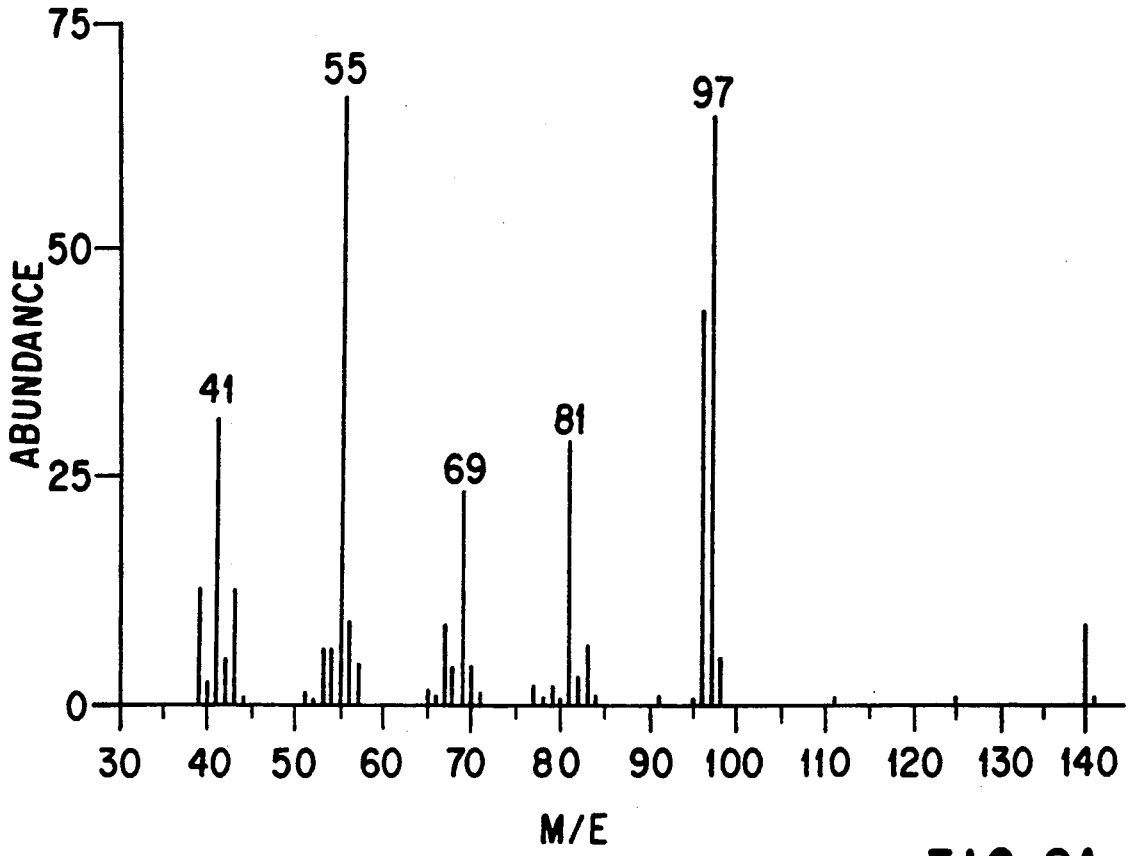
FIG. 2(*a–b*) shows the GC/MS of trans-1-methyl-4-(1-methylethyl) cyclohexane. Panel A is the mass spectrum of a standard sample. Panel B shows is one of the compounds produced by the cracking/hydrogenation of limonene.
Figure 2B:
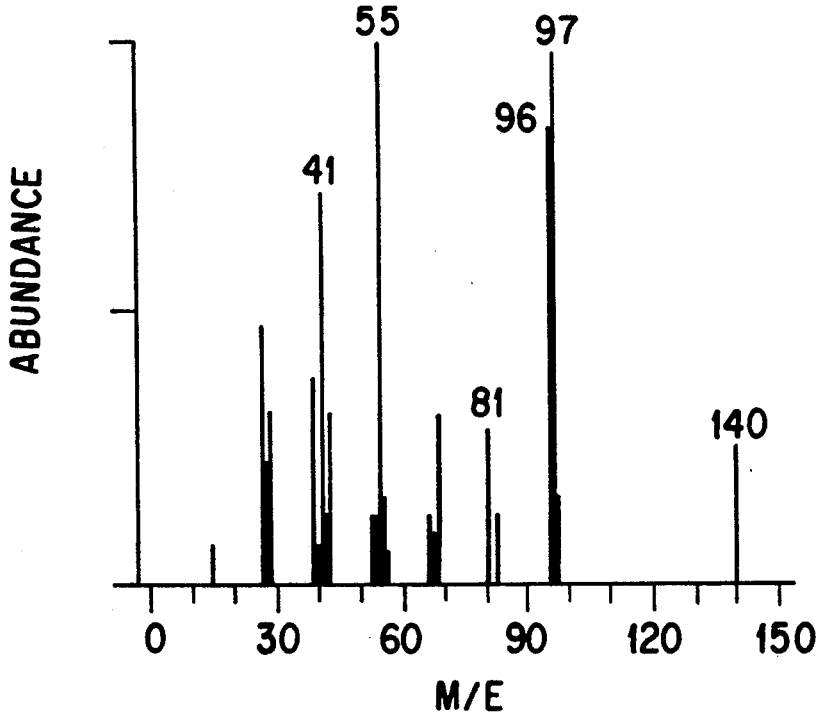
Figure 3A:
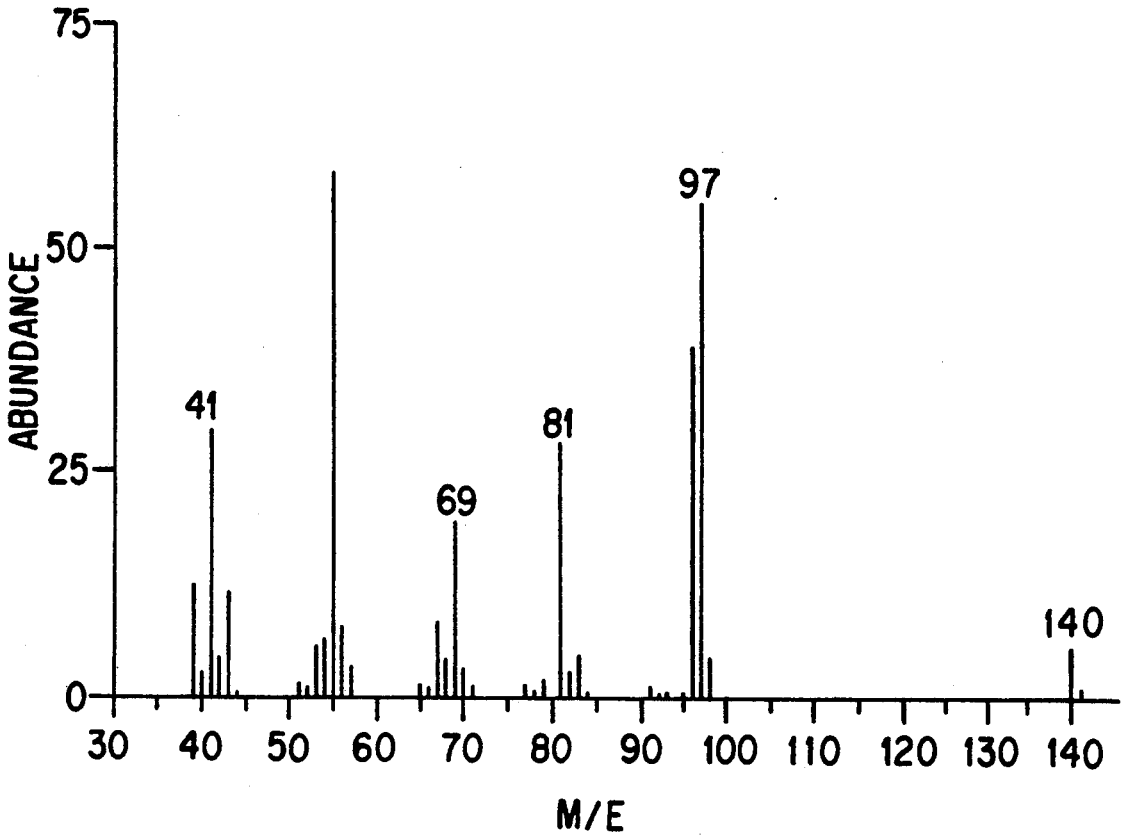
FIG. 3(*a–b*) shows the GC/MS of cis 1-methyl-4-(1-methylethyl) cyclohexane. Panel A is the mass spectrum of a standard sample. Panel B shows one of the compounds produced by the cracking/dehydrogenation of limonene.
Figure 3B:
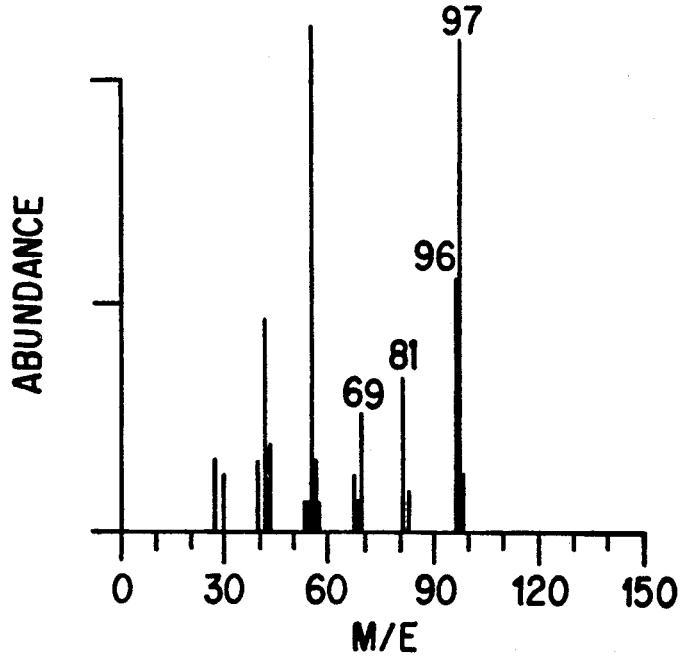
Figure 4A:
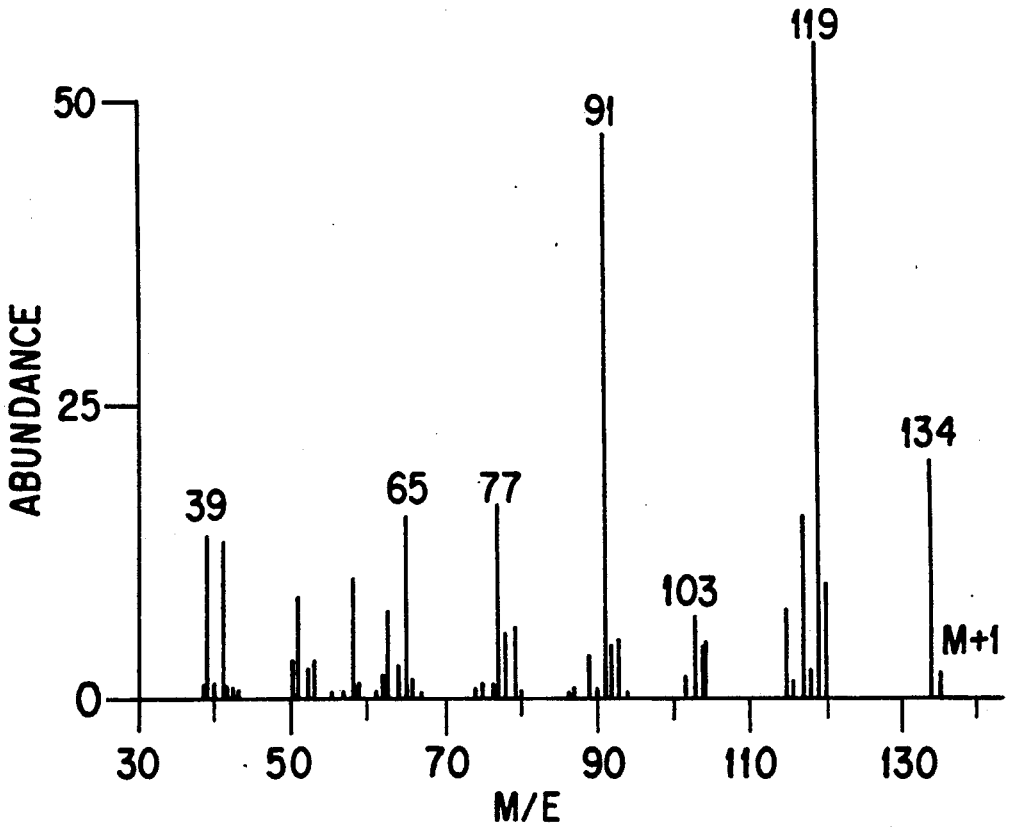
FIG. 4(*a–b*) shows the GC/MS of 1-methyl-4-(1-methylethyl) benzene. Panel A is the mass spectrum of a standard sample. Panel B shows one of the major products produced by cracking/dehydrogenation of limonene under low pressure conditions.
Figure 4B:
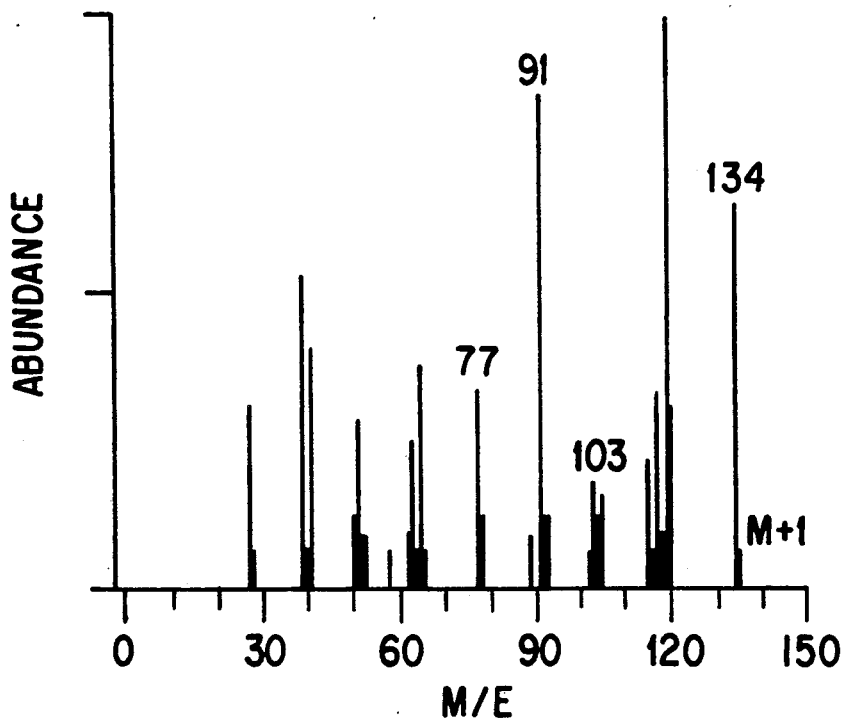

600 ml of purified d-limonene was placed in a 1-liter flask with 12.5 g of 1% Pd on carbon. The mixture was heated to 105° C. for 2 hr at ambient pressure while bubbling nitrogen through the solution. After cooling to room temperature, the catalyst was removed by filtration. The clear, colorless liquid was distilled at atmospheric pressure and the fraction boiling between 175°–178° C. collected as a clear colorless liquid which had a specific gravity of 0.85 g/ml. Gas chromatographic analysis of the collected product showed two peaks. Mass spectrometry of the product components and comparison with published libraries of known compounds were used to identify 1-methyl-4-(1-methylethyl)benzene and 1-methyl-4-(1-methylethyl)cyclohexene as the products. Structures are shown in FIG. 1. Mass spectra are shown in FIG. 2. Table 1, showing relative amounts of the mixture components, indicates product composition is over 80% 1-methyl-4-(1-methylethyl)benzene and 17% 1-methyl-4-(1-methylethyl)cyclohexene. Minor amounts of 1-methyl-4-(1methylethyl)cyclohexane and trace amounts, less than 1%, of other hydrocarbon components were also detected.

TABLE 1

Composition of Products Formed in the Catalytic Reactions of d-Limonene

| Chemical Name | Formula | Product (%) |
|---|---|---|
| t-MMEC[1] | $C_{10}H_{20}$ | 2 |
| c-MMEC[2] | $C_{10}H_{20}$ | |
| 1-methyl-4-(1-methylethyl) cyclohexene | $C_{10}H_{18}$ | 17 |
| 1-methyl-4-(1-methylethyl) benzene | $C_{10}H_{14}$ | 81 |

[1]t-MMEC = trans-1-methyl-4-(1-methylethyl) cyclohexane
[2]c-MMEC = cis-1-methyl-4-(1-methylethyl) cyclohexane

EXAMPLE 2

Catalytic Conversion of Limonene to Saturated Hydrocarbon Products (Method B 2.0 liters of purified limonene was placed in a 4.2 liter stainless steel cylinder with 40 g of 5% Pd on carbon. Initial pressure was 1200 psi with heating at 365°–370° C. for five hours. Pressure increased to 1750 psi during heating and fell to 500 after the cylinder was cooled to room temperature. Specific gravity of the product mixture was 0.788 g/ml. Mass spectrometric/gas chromatographic analysis showed two major products: 1-methyl-4-(1-methylethyl) cyclohexane (cis and trans isomers). Trace amounts (<0.01%) included hexane, 3,3,5-trimethyl heptane, 1-(1,5-dimethylhexyl)-4-methylcyclohexane, 1S,3R-(+)- and 1S,3S-(+)-m-menthane and cyclohexanepropanoic acid.

Product composition is shown in Table 2.

TABLE 2

Composition of Products Formed in the Catalytic Reactions of d-Limonene

| Chemical Name | Formula | Product (%) |
|---|---|---|
| 3,3,5-trimethyl heptane | $C_{10}H_{22}$ | trace |
| DMHMC[1] | $C_{15}H_{30}$ | trace |
| t-MMEC[2] | $C_{10}H_{20}$ | 69.58 |
| c-MMEC[3] | $C_{10}H_{20}$ | 30.14 |
| (1S, 3R)-(+)-m-menthane | $C_{10}H_{20}$ | trace |
| Cyclohexanepropanoic acid | $C_9H_{16}O_2$ | trace |
| (1S, 3S)-(+)-m-menthane | $C_{10}H_{20}$ | trace |

[1]DMHMC = (1-(1,5-dimethylhexyl)-4-methyl cyclohexane
[2]t-MMEC = trans-1-methyl-4-(1-methylethyl) cyclohexane
[3]c-MMEC = cis-1-methyl-4-(1-methylethyl) cyclohexane

EXAMPLE 3

Engine Tests on 87 Octane Gasoline Blended with Limonene

Gasoline obtained locally from retail gasoline stations was tested on a dynamometer constructed and set up as described for the test engine. Exxon 87 octane gasoline was used as a control. Test samples were prepared by adding 5%, 10% or 20% limonene to Shamrock 87 octane gasoline. All samples were run under the same test conditions. Results of these tests are shown in Tables 3–6.

Table 3 shows the results of dynamometer tests with Exxon 87 octane gasoline. Engine knock sufficient to cause automatic shutdown of the test dynamometer described in Example 1, occurred above 3250 rpm.

Tables 4–6 show the effect of adding increasing amounts of limonene to Shamrock 87 octane gasoline. As shown in Table 4, engine shutdown occurred above 3000 rpm with the addition of 5% limonene and above 2250 rpm with 10% Limonene. In the presence of 20% limonene, serious preignition occurred shortly after starting at 2000 rpm, causing automatic shutdown of the test engine. Preignition was severe, causing explosive knocking just prior to shutdown.

Cylinder temperature, indicated from thermocouple measurements on each cylinder, showed a tendency to decrease when the biomass fuel mixture was added to gasoline. This indicated a decrease in heat of combustion.

TABLE 3

Standard Corrected Data for 29.92 inches Hg. 60 F. dry air Test #113

Test: 250 RPM Step Test Fuel Spec. Grav.: .740 Air Sensor 6.5
Vapor Pressure: .35 Barometric Pres.: 29.62 Ratio: 1.00 to 1
Engine Type: 4-Cycle Spark Engine Displacement: 358.0 Stroke: 3.480

| Speed rpm | CBTrq lb-Ft | CBPwr Hp | FHp Hp | VE % | ME % | FA lb/hr | A1 scfm | A/F | BSFC lb/Hphr | CAT | Oil | Wat | BSAC lb/Hphr |
|---|---|---|---|---|---|---|---|---|---|---|---|---|---|
| 2000 | 326.3 | 124.3 | 17.4 | 84.7 | 87.2 | 52.5 | 166.1 | 14.5 | .44 | 77 | 193 | 0 | 6.41 |
| 2250 | 340.0 | 145.7 | 20.7 | 87.3 | 87.1 | 61.6 | 192.7 | 14.4 | .44 | 77 | 194 | 0 | 6.35 |
| 2500 | 338.9 | 161.3 | 24.3 | 86.6 | 86.4 | 66.8 | 212.5 | 14.6 | .43 | 77 | 196 | 0 | 6.32 |
| 2750 | 343.2 | 179.7 | 28.1 | 87.5 | 86.0 | 72.1 | 236.2 | 15.0 | .42 | 77 | 197 | 0 | 6.31 |
| 3000 | 349.8 | 199.8 | 32.1 | 88.2 | 85.6 | 80.3 | 259.5 | 14.8 | .42 | 77 | 199 | 0 | 6.23 |
| 3250 | 352.6 | 218.2 | 36.4 | 89.0 | 85.2 | 88.4 | 283.9 | 14.7 | .42 | 77 | 200 | 0 | 6.24 |
| 3500 | 39.7 | 26.5 | 41.1 | 14.4 | 36.8 | 11.3 | 49.3 | 20.0 | .47 | 77 | 204 | 0 | 9.47 |

SF-901 Dynamometer Test Data

Test: 250 RPM Step Test Fuel Spec. Grav.: .740 Air Sensor 6.5
Vapor Pressure: .35 Barometric Pres.: 29.62 Ratio: 1.00 to 1
Engine Type: 4-Cycle Spark Engine Displacement: 358.0 Stroke: 3.480

Thermocouple Temperature

| 1 | 2 | 3 | 4 | 5 | 6 | 7 | 8 |
|---|---|---|---|---|---|---|---|
| 1300 | 1290 | 1160 | 1220 | 1210 | 110 | 1180 | 1220 |
| 1310 | 1270 | 1160 | 1220 | 1210 | 130 | 1210 | 1250 |
| 1300 | 1260 | 1170 | 1220 | 1220 | 160 | 1230 | 1280 |
| 1290 | 1270 | 1180 | 1240 | 1230 | 110 | 1260 | 1300 |
| 1300 | 1270 | 1200 | 1270 | 1250 | 460 | 1270 | 1310 |
| 1310 | 1280 | 1220 | 1290 | 1270 | 600 | 1290 | 1320 |
| 1260 | 1260 | 1180 | 1240 | 1230 | 350 | 1240 | 1270 |
| 1210 | 1190 | 1130 | 1150 | 1180 | 320 | 1190 | 1220 |
| 1180 | 1140 | 1090 | 1090 | 1130 | 300 | 1160 | 1190 |

TABLE 4

Standard Corrected Data for 29.92 inches Hg. 60 F. dry air Test #114

Test: 250 RPM Step Test Fuel Spec. Grav.: .747 Air Sensor 6.5
Vapor Pressure: .35 Barometric Pres.: 29.62 Ratio: 1.00 to 1
Engine Type: 4-Cycle Spark Engine Displacement: 358.0 Stroke: 3.480

| Speed rpm | CBTrq lb-Ft | CBPwr Hp | FHp Hp | VE % | ME % | FA lb/hr | A1 scfm | A/F | BSFC lb/Hphr | CAT | Oil | Wat | BSAC lb/Hphr |
|---|---|---|---|---|---|---|---|---|---|---|---|---|---|
| 2000 | 326.3 | 124.3 | 17.4 | 84.7 | 87.2 | 52.5 | 166.1 | 14.5 | .44 | 77 | 193 | 0 | 6.41 |
| 2250 | 342.5 | 146.7 | 20.7 | 86.9 | 87.1 | 62.1 | 191.8 | 14.2 | .44 | 77 | 186 | 0 | 6.27 |
| 2500 | 345.4 | 164.4 | 24.3 | 87.5 | 86.6 | 69.8 | 214.7 | 14.1 | .44 | 77 | 185 | 0 | 6.26 |
| 2750 | 349.8 | 183.2 | 28.1 | 86.9 | 86.2 | 73.5 | 234.4 | 14.6 | .42 | 77 | 185 | 0 | 6.14 |
| 3000 | 354.5 | 202.5 | 32.1 | 87.5 | 85.8 | 81.0 | 257.7 | 14.6 | .42 | 77 | 184 | 0 | 6.11 |
| 3250 | 39.2 | 24.3 | 36.4 | 13.3 | 37.6 | 9.6 | 42.5 | 20.3 | .44 | 77 | 185 | 0 | 8.87 |

SF-901 Dynamometer Test Data

Test: 250 RPM Step Test Fuel Spec. Grav.: .747 Air Sensor 6.5
Vapor Pressure: .35 Barometric Pres.: 29.62 Ratio: 1.00 to 1
Engine Type: 4-Cycle Spark Engine Displacement: 358.0 Stroke: 3.480

Thermocouple Temperature

| 1 | 2 | 3 | 4 | 5 | 6 | 7 | 8 |
|---|---|---|---|---|---|---|---|
| 1120 | 1100 | 980 | 990 | 1010 | 420 | 1110 | 1090 |
| 1170 | 1130 | 1030 | 1050 | 1050 | 240 | 1150 | 1140 |
| 1190 | 1150 | 1070 | 1090 | 1090 | 170 | 1190 | 1190 |
| 1220 | 1190 | 1110 | 1150 | 1140 | 160 | 1230 | 1230 |
| 1250 | 1220 | 1150 | 1200 | 1180 | 110 | 1240 | 1250 |
| 1190 | 1190 | 1100 | 1130 | 1120 | 110 | 1180 | 1200 |
| 1120 | 1110 | 1030 | 1020 | 1050 | 200 | 1100 | 1120 |
| 1060 | 1040 | 990 | 990 | 1010 | 1020 | 1040 | 1050 |

TABLE 5

Standard Corrected Data for 29.92 inches Hg. 60 F. dry air Test #115

Test: 250 RPM Step Test Fuel Spec. Grav.: .755 Air Sensor 6.5
Vapor Pressure: .35 Barometric Pres.: 29.61 Ratio: 1.00 to 1
Engine Type: 4-Cycle Spark Engine Displacement: 358.0 Stroke: 3.480

| Speed rpm | CBTrq lb-Ft | CBPwr Hp | FHp Hp | VE % | ME % | FA lb/hr | A1 scfm | A/F | BSFC lb/Hphr | CAT | Oil | Wat | BSAC lb/Hphr |
|---|---|---|---|---|---|---|---|---|---|---|---|---|---|
| 2000 | 327.6 | 124.8 | 17.4 | 86.5 | 87.3 | 54.4 | 169.6 | 14.3 | .46 | 77 | 190 | 0 | 6.52 |
| 2250 | 341.5 | 146.3 | 20.7 | 87.0 | 87.1 | 61.8 | 191.9 | 14.3 | .44 | 77 | 193 | 0 | 6.29 |

TABLE 5-continued

| | | | | | | | | | | | | | |
|---|---|---|---|---|---|---|---|---|---|---|---|---|---|
| 2500 | 36.8 | 17.5 | 24.3 | 17.3 | 39.6 | 8.9 | 42.6 | 22.0 | .56 | 77 | 195 | 0 | 12.30 |
| 2750 | 2.1 | 1.1 | 28.1 | 8.4 | .0 | 8.5 | 22.7 | 12.3 | .00 | 77 | 196 | 0 | .00 |
| 3000 | 2.2 | 1.3 | 32.1 | 3.7 | .0 | .0 | 11.0 | .0 | .00 | 77 | 197 | 0 | .00 |
| 3250 | 2.3 | 1.4 | 36.4 | 2.3 | .0 | 2.3 | 7.4 | 14.8 | .00 | 77 | 199 | 0 | .00 |

SF-901 Dynamometer Test Data

Test: 250 RPM Step Test — Fuel Spec. Grav.: .755 — Air Sensor 6.5
Vapor Pressure: .35 — Barometric Pres.: 29.61 — Ratio: 1.00 to 1
Engine Type: 4-Cycle Spark — Engine Displacement: 358.0 — Stroke: 3.480

Thermocouple Temperature

| 1 | 2 | 3 | 4 | 5 | 6 | 7 | 8 |
|---|---|---|---|---|---|---|---|
| 1300 | 1270 | 1140 | 1200 | 1210 | 330 | 1220 | 1240 |
| 1300 | 1260 | 1160 | 1210 | 1210 | 120 | 1230 | 1260 |
| 1240 | 1230 | 1110 | 1150 | 1160 | 110 | 1190 | 1210 |
| 1180 | 1180 | 1070 | 1090 | 1110 | 110 | 1140 | 1160 |
| 1110 | 1100 | 1020 | 1050 | 1060 | 100 | 1060 | 1090 |
| 1040 | 1030 | 970 | 1000 | 1010 | 130 | 990 | 1020 |

TABLE 6

Standard Corrected Data for 29.92 inches Hg. 60 F. dry air — Test #116

Test: 250 RPM Step Test — Fuel Spec. Grav.: .768 — Air Sensor 6.5
Vapor Pressure: .35 — Barometric Pres.: 29.62 — Ratio: 1.00 to 1
Engine Type: 4-Cycle Spark — Engine Displacement: 358.0 — Stroke: 3.480

| Speed rpm | CBTrq lb-Ft | CBPwr Hp | FHp Hp | VE % | ME % | FA lb/hr | A1 scfm | A/F | BSFC lb/Hphr | CAT | Oil | Wat | BSAC lb/Hphr |
|---|---|---|---|---|---|---|---|---|---|---|---|---|---|
| 2000 | 331.7 | 126.3 | 17.4 | 84.7 | 87.4 | 52.6 | 166.2 | 14.5 | .44 | 77 | 190 | 0 | 6.31 |
| 2250 | 37.0 | 15.9 | 20.7 | 17.5 | 41.1 | 9.0 | 38.6 | 19.7 | .62 | 77 | 194 | 0 | 12.22 |
| 2500 | 2.0 | 1.0 | 24.3 | 6.1 | .0 | .0 | 14.9 | .0 | .00 | 77 | 194 | 0 | .00 |
| 2750 | 2.1 | 1.1 | 28.1 | 3.4 | .0 | .0 | 9.1 | .0 | .00 | 77 | 194 | 0 | .00 |
| 3000 | 2.2 | 1.3 | 32.1 | 2.2 | .0 | .0 | 6.4 | .0 | .00 | 77 | 196 | 0 | .00 |

SF-901 Dynamometer Test Data

Test: 250 RPM Step Test — Fuel Spec. Grav.: .768 — Air Sensor 6.5
Vapor Pressure: .35 — Barometric Pres.: 29.62 — Ratio: 1.00 to 1
Engine Type: 4-Cycle Spark — Engine Displacement: 358.0 — Stroke: 3.480

Thermocouple Temperature

| 1 | 2 | 3 | 4 | 5 | 6 | 7 | 8 |
|---|---|---|---|---|---|---|---|
| 1270 | 1250 | 1130 | 1180 | 1190 | 240 | 1170 | 1200 |
| 1210 | 1210 | 1090 | 1120 | 1130 | 110 | 1120 | 1160 |
| 1140 | 1130 | 1040 | 1070 | 1080 | 110 | 1050 | 1090 |
| 1070 | 1040 | 990 | 1020 | 1010 | 100 | 990 | 1030 |
| 1000 | 980 | 930 | 970 | 950 | 100 | 930 | 970 |

EXAMPLE 4

Irradiation/Catalytic Conversion of Limonene (Method C)

600 ml of purified limonene, b.p. 175°-177° C., was placed in a 1-liter three-necked glass flask equipped with a temperature probe and a gas inlet tube. 10 g of 5% Pd/C was added to the flask, hydrogen gas was bubbled into the mixture and the limonene heated to reflux for 2 hr. An ultraviolet lamp (Spectroline providing 254 nm light) was placed on top of the reflux column so that light impinged vapor produced by heating the pot liquid to distillation temperature. The distillate was collected over a temperature range of 140°-180° C. and analyzed by gas chromatography/mass spectrometry. Fragmentation products included $C_5$ and $C_6$ fragments and $C_{10}H_{20}$ compounds. The latter were identified as cis and trans-1-methyl-4-(1-methylethyl) cyclohexane and 1-methyl-4-(1-methylethyl) benzene, structures shown in FIG. 1. Product distribution and identified products are shown in Table 7.

TABLE 7

Composition of Products Formed in the Catalytic Reaction of d-Limonene with UV Irradiation

| Chemical Name | Formula | Composition (%) |
|---|---|---|
| 3,3,5-trimethyl heptane | $C_{10}H_{22}$ | <1 |

TABLE 7-continued

Composition of Products Formed in the Catalytic Reaction of d-Limonene with UV Irradiation

| Chemical Name | Formula | Composition (%) |
|---|---|---|
| 4-methyl-2-propyl 1-pentanol | $C_9H_{20}O$ | <1 |
| Dodecane | $C_{12}H_{26}$ | <1 |
| 3-methyl nonane | $C_{10}H_{22}$ | 1.4 |
| trans-1-methyl-4-(1-methylethyl) cyclohexane | $C_{10}H_{20}$ | 25.1 |
| cis-1-methyl-4-(1-methylethyl) cyclohexane | $C_{10}H_{20}$ | 21.5 |
| 1-methyl-4-(1-methylethylidene)-cyclohexane | $C_{10}H_{18}$ | 18.7 |
| cis-4-dimethyl cyclohexaneethanol | $C_{10}H_{20}O$ | 2.8 |
| 1-methyl-4-(1-methylethyl) benzene | $C_{10}H_{14}$ | 30.2 |

EXAMPLE 5

Catalytic Conversion of Limonene (Method D)

A biomass fuel mixture was obtained using a variation of the preparation of Example 1. Table 8 shows the product distribution of products produced from the reaction which was conducted by adding 40 g of barium-promoted copper chromite (35 $m^2/g$, 9.7% BaO) to 2.0 liters of purified limonene. The limonene was charged into a 4.2 liter metal cylinder, evacuated and pressurized with hydrogen gas at 500 psi. The mixture was heated to 230° C. for 3 hr. The cylinder was cooled with a stream of liquid nitrogen, opened and the liquid bubbled with hydrogen gas, catalyst removed and the mixture distilled. The distillate was collected over a range of 110°–180° C.

Mixture components were 45% $C_{10}H_{14}$ and about 55% $C_{10}H_{20}$ with trace amounts of 1-methyl-4-(1-methylethyl)-cyclohexene, cis-p-menth-8(10)en-ol, 3-methyl nonane and 1-methyl-3-(1-methylethyl) benzene as determined by gas chromatography.

EXAMPLE 6

Engine Tests on 87 Octane Gasoline Blended With Biomass Fuel or MTBE

A biomass fuel mixture was prepared under substantially the same conditions of Example 1. The mixture was added in 10% and 20% by volume to Mobil 87 octane gasoline purchased from local retail gasoline stations. Another mixture was prepared by adding methyl tert-butyl ether (MTBE) to 87 octane Mobil gasoline in 10% by volume. Dynode tests were run on all mixtures using the aforementioned test engine. Table 9 shows results of dynamometer tests on Mobil 87 octane gasoline; Table 10 shows results of addition of 10% by volume biomass fuel mixture and Table 11 results of addition of 20% of biomass fuel to the 87 octane gasoline. Not shown are results with the MTBE blend which were similar to results obtained with the blend containing 10% biomass fuel mixture.

Results showed that addition of up to 20% of the biomass generated fuel mixture caused no decrease in horsepower or torque at rpms in the range up to about 3000 rpms. Above 3000 rpms, addition of the biomass fuel mixture in about 10% by volume to the 87 octane gasoline provided about 1% increase in horsepower and torque at 4250 rpms (compare Table, third column, and Table 10, third column). Addition of 20% by volume of the biomass fuel mixture did not significantly change horsepower or torque up to about 4250 rpms when compared with 87 octane gasoline (compare Table 9, third column, and Table 11, third column). MTBE added at 10% by volume was similar in effect to the blend containing 10% biomass fuel mixture in averaging increases in horsepower of about 0.7–1.1%.

Additionally, as the amount of biomass fuel mixture added to conventional gasoline was increased, the A/F (air-to fuel ratio) ratio decreased somewhat. Cylinder temperature, measured in each cylinder by thermocouple, did not appear to be significantly affected.

TABLE 8

Composition of Products Formed in the Catalytic Conversion of d-Limonene

| Chemical Name | Formula | Product (%) |
|---|---|---|
| t-MMTC[1] | $C_{10}H_{20}$ | 37.6 |
| c-MMTC[2] | $C_{10}H_{20}$ | 16.7 |
| cis-p-menth-8(10)-en-9-ol | $C_{10}H_{18}O$ | <1 |
| 1-methyl-4-(1-methylethyl)-cyclohexene | $C_{10}H_{18}$ | <1 |
| 1-methyl-4-(1-methylethyl) benzene | $C_{10}H_{14}$ | 45.1 |
| 1-methyl-3-(1-methylethyl) benzene | $C_{10}H_{14}$ | 1 |
| 3-methyl nonane | $C_{10}H_{22}$ | <1 |

[1]t-MMTC = trans-1-methyl-4-(1-methylethyl) cyclohexane
[2]c-MMTC = cis-1-methyl-4-(1-methylethyl) cyclohexane

TABLE 9

Standard Corrected Data for 29.92 inches Hg. 60° F. dry air Test #150

Test: 250 RPM Step Test; Fuel Spec. Grav.: .732; Air Sensor 6.5
Vapor Pressure: .91; Barometric Pres.: 29.33; Ratio: 1.00 to 1
Engine Type: 4-Cycle Spark; Engine Displacement: 355.0; Stroke: 3.480

| Speed rpm | CBTrq lb-Ft | CBPwr Hp | FHp Hp | VE % | ME % | FA lb/hr | A1 scfm | A/F | BSFC lb/Hphr | CAT | Oil | Wat | BSAC lb/Hphr |
|---|---|---|---|---|---|---|---|---|---|---|---|---|---|
| 2000 | 335.4. | 127.7 | 17.3 | 77.8 | 87.2 | 58.4 | 147.1 | 11.6 | .49 | 77 | 193 | 170 | 5.71 |
| 2250 | 339.8 | 145.6 | 20.6 | 79.5 | 86.8 | 67.1 | 168.9 | 11.6 | .50 | 77 | 193 | 167 | 5.76 |
| 2500 | 343.5 | 163.5 | 24.1 | 78.9 | 86.3 | 72.9 | 186.3 | 11.7 | .48 | 77 | 194 | 166 | 5.66 |
| 2750 | 348.8 | 182.6 | 27.9 | 79.7 | 85.8 | 82.1 | 207.0 | 11.6 | .49 | 77 | 194 | 165 | 5.63 |
| 3000 | 358.1 | 204.6 | 31.8 | 80.8 | 85.6 | 90.2 | 229.0 | 11.7 | .48 | 77 | 194 | 165 | 5.56 |
| 3250 | 366.6 | 226.9 | 36.1 | 81.8 | 85.3 | 99.1 | 251.5 | 11.7 | .47 | 77 | 194 | 166 | 5.50 |
| 3500 | 372.1 | 248.0 | 40.7 | 82.9 | 84.9 | 107.8 | 274.3 | 11.7 | .47 | 77 | 195 | 166 | 5.49 |
| 3750 | 374.1 | 267.1 | 46.0 | 83.7 | 84.3 | 113.3 | 296.8 | 12.0 | .46 | 77 | 196 | 166 | 5.52 |
| 4000 | 372.3 | 283.5 | 51.6 | 84.0 | 83.5 | 121.9 | 317.6 | 12.0 | .47 | 77 | 198 | 168 | 5.57 |
| 4250 | 375.0 | 303.5 | 57.5 | 85.2 | 82.9 | 134.0 | 342.4 | 11.7 | .48 | 77 | 199 | 168 | 5.62 |

SF-901 Dynamometer Test Data

Test: 250 RPM Step Test; Fuel Spec. Grav.: .732; Air Sensor 6.5
Vapor Pressure: .91; Barometric Pres.: 29.33; Ratio: 1.00 to 1
Engine Type: 4-Cycle Spark; Engine Displacement: 355.0; Stroke: 3.480

Thermocouple Temperature

| 1 | 2 | 3 | 4 | 5 | 6 | 7 | 8 |
|---|---|---|---|---|---|---|---|
| 1250 | 1260 | 1170 | 1190 | 1100 | 1200 | 1280 | 1310 |
| 1240 | 1250 | 1180 | 1190 | 1100 | 1230 | 1290 | 1300 |
| 1250 | 1260 | 1200 | 1140 | 1110 | 1250 | 1300 | 1300 |
| 1270 | 1260 | 1230 | 1180 | 1120 | 1280 | 1300 | 1300 |
| 1280 | 1270 | 1250 | 1160 | 1140 | 1140 | 1310 | 1310 |
| 1290 | 1290 | 1270 | 1220 | 1160 | 1330 | 1330 | 1330 |
| 1320 | 1300 | 1280 | 1270 | 1190 | 1360 | 1350 | 1360 |
| 1340 | 1320 | 1300 | 1310 | 1230 | 1380 | 1360 | 1390 |
| 1360 | 1330 | 1310 | 1330 | 1260 | 1410 | 1360 | 1410 |
| 1370 | 1360 | 1320 | 1350 | 1300 | 1440 | 1380 | 1440 |

TABLE 10

Standard Corrected Data for 29.9 inches Hg, 60° F. dry air Test #117

Test: 250 RPM Step Test; Fuel Spec. Grav.: .738; Air Sensor: 6.5
Vapor Pressure: .85; Barometric Pres.: 29.23; Ratio: 1.00 to 1
Engine Type: 4-Cycle Spark; Engine displacement: 355.0; Stroke: 3.480

| Speed rpm | CBTrq lb-Ft | CBPwr Hp | FHp Hp | VE % | ME % | FA lb/hr | A1 scfm | A/F | BSFC lb/Hphr | CAT | Oil | Wat | BSAC lb/Hphr |
|---|---|---|---|---|---|---|---|---|---|---|---|---|---|

TABLE 10-continued

| | | | | | | | | | | | | | |
|---|---|---|---|---|---|---|---|---|---|---|---|---|---|
| 2000 | 333.4 | 127.0 | 17.3 | 76.4 | 87.2 | 67.2 | 144.2 | 9.9 | .57 | 77 | 200 | 167 | 5.64 |
| 2250 | 339.0 | 145.2 | 20.6 | 79.1 | 86.7 | 95.4 | 168.0 | 8.1 | .71 | 77 | 201 | 170 | 5.75 |
| 2500 | 345.1 | 164.3 | 24.1 | 79.1 | 86.3 | 101.6 | 186.7 | 8.4 | .67 | 77 | 200 | 170 | 5.65 |
| 2750 | 350.7 | 183.6 | 27.9 | 79.7 | 85.9 | 112.9 | 206.9 | 8.4 | .67 | 77 | 200 | 170 | 5.60 |
| 3000 | 362.4 | 207.0 | 31.8 | 81.0 | 85.7 | 113.8 | 229.3 | 9.3 | .60 | 77 | 201 | 169 | 5.5 |
| 3250 | 369.4 | 228.6 | 36.1 | 81.7 | 85.4 | 124.5 | 250.7 | 9.2 | .59 | 77 | 202 | 169 | 5.45 |
| 3500 | 375.8 | 250.4 | 40.7 | 82.7 | 85.0 | 135.2 | 273.3 | 9.3 | .59 | 77 | 202 | 169 | 5.43 |
| 3750 | 379.3 | 270.8 | 46.0 | 83.7 | 84.5 | 141.2 | 296.1 | 9.6 | .57 | 77 | 202 | 169 | 5.44 |
| 4000 | 377.2 | 287.3 | 51.6 | 84.1 | 83.7 | 146.6 | 317.5 | 9.9 | .55 | 77 | 203 | 169 | 5.50 |
| 4250 | 379.1 | 306.8 | 57.5 | 85.1 | 83.1 | 159.2 | 341.5 | 9.9 | .56 | 77 | 204 | 170 | 5.54 |

SF-901 Dynamometer Test Data

Test: 250 RPM Step Test — Fuel Spec. Grav.: .738 — Air Sensor: 6.5
Vapor Pressure: .85 — Barometric Pres.: 29.23 — Ratio: 1.00 to 1
Engine Type: 4-cycle Spark — Engine displacement: 355.0 — Stroke: 3.480

Thermocouple Temperature

| 1 | 2 | 3 | 4 | 5 | 6 | 7 | 8 |
|---|---|---|---|---|---|---|---|
| 1270 | 1280 | 1230 | 1250 | 1140 | 1300 | 1290 | 1320 |
| 1270 | 1260 | 1240 | 1210 | 1120 | 1310 | 1300 | 1300 |
| 1280 | 1260 | 1250 | 1200 | 1130 | 1310 | 1310 | 1300 |
| 1290 | 1260 | 1260 | 1190 | 1140 | 1320 | 1290 | 1310 |
| 1300 | 1270 | 1280 | 1200 | 1150 | 1340 | 1300 | 1320 |
| 1310 | 1270 | 1300 | 1240 | 1170 | 1360 | 1320 | 1340 |
| 1330 | 1290 | 1320 | 1280 | 1200 | 1380 | 1340 | 1370 |
| 1350 | 1310 | 1330 | 1310 | 1240 | 1400 | 1350 | 1390 |
| 1370 | 1330 | 1340 | 1340 | 1270 | 1420 | 1350 | 1420 |
| 1380 | 1360 | 1350 | 1230 | 1300 | 1450 | 1380 | 1430 |

TABLE 11

Standard Corrected Data for 29.9 inches Hg, 60° F. dry air — Test #154

Test: 250 RPM Step Test — Fuel Spec. Grav.: .757 — Air Sensor: 6.5
Vapor Pressure: .91 — Barometric Pres.: 29.33 — Ratio: 1.00 to 1
Engine Type: 4-Cycle Spark — Engine displacement: 355.0 — Stroke: 3.480

| Speed rpm | CBTrq lb-Ft | CBPwr Hp | FHp Hp | VE % | ME % | FA lb/hr | A1 scfm | A/F | BSFC lb/Hphr | CAT | Oil | Wat | BSAC lb/Hphr |
|---|---|---|---|---|---|---|---|---|---|---|---|---|---|
| 2000 | 332.4 | 126.6 | 17.3 | 75.8 | 87.1 | 105.1 | 143.1 | 6.3 | .90 | 77 | 195 | 170 | 5.60 |
| 2250 | 336.6 | 144.2 | 20.6 | 78.6 | 86.6 | 111.4 | 167.1 | 6.9 | .84 | 77 | 195 | 173 | 5.75 |
| 2500 | 344.4 | 163.9 | 24.1 | 78.8 | 86.3 | 123.4 | 186.1 | 6.9 | .81 | 77 | 195 | 174 | 5.63 |
| 2750 | 349.3 | 182.9 | 27.9 | 79.6 | 85.9 | 145.3 | 206.7 | 6.5 | .86 | 77 | 196 | 173 | 5.61 |
| 3000 | 358.2 | 204.6 | 31.8 | 80.8 | 85.6 | 156.0 | 229.1 | 6.7 | .82 | 77 | 195 | 171 | 5.56 |
| 3250 | 367.5 | 227.4 | 36.1 | 81.7 | 85.3 | 158.6 | 251.1 | 7.3 | .75 | 77 | 196 | 171 | 5.49 |
| 3500 | 372.0 | 247.9 | 40.7 | 82.7 | 84.9 | 175.2 | 273.5 | 7.2 | .77 | 77 | 199 | 168 | 5.48 |
| 3750 | 375.2 | 267.9 | 46.0 | 83.7 | 84.3 | 184.3 | 296.4 | 7.4 | .75 | 77 | 199 | 168 | 5.50 |
| 4000 | 374.1 | 284.9 | 51.6 | 84.0 | 83.6 | 193.8 | 317.6 | 7.5 | .74 | 77 | 199 | 170 | 5.55 |
| 4250 | 375.4 | 303.8 | 57.5 | 85.1 | 83.0 | 199.7 | 341.6 | 7.9 | .71 | 77 | 202 | 170 | 5.60 |

SF-901 Dynamometer Test Data

Test: 250 RPM Step Test — Fuel Spec. Grav.: .757 — Air Sensor: 6.5
Vapor Pressure: .91 — Barometric Pres.: 29.33 — Ratio: 1.00 to 1
Engine Type: 4-Cycle Spark — Engine displacement: 355.0 — Stroke: 3.480

Thermocouple Temperature

| 1 | 2 | 3 | 4 | 5 | 6 | 7 | 8 |
|---|---|---|---|---|---|---|---|
| 1240 | 1250 | 1220 | 1230 | 1140 | 1290 | 1290 | 1340 |
| 1250 | 1250 | 1210 | 1200 | 1130 | 1300 | 1290 | 1340 |
| 1260 | 1260 | 1220 | 1180 | 1130 | 1310 | 1300 | 1340 |
| 1270 | 1270 | 1240 | 1180 | 1130 | 1320 | 1290 | 1330 |
| 1270 | 1280 | 1270 | 1220 | 1140 | 1340 | 1300 | 1340 |
| 1280 | 1290 | 1280 | 1250 | 1160 | 1360 | 1310 | 1350 |
| 1310 | 1300 | 1290 | 1270 | 1190 | 1370 | 1330 | 1360 |
| 1340 | 1320 | 1300 | 1270 | 1220 | 1390 | 1340 | 1400 |
| 1360 | 1330 | 1310 | 1230 | 1260 | 1420 | 1340 | 1420 |
| 1370 | 1360 | 1320 | 1350 | 1290 | 1450 | 1360 | 1450 |

EXAMPLE 7

Engine Tests on Biomass Fuel

A fuel mixture was obtained from 2 liters of limonene feedstock using the process of Example 1. Analysis of the mixture obtained after distillation showed 69% of a $C_{10}H_{14}$ compound identified as 1-methyl-4-(1-methylethyl)benzene, about 31% of a $C_{10}H_{18}$ compound identified as 1-methyl-4-(1-methylethyl) cyclohexene with trace amounts (less than 1% total) of m-menthane, 2,6-dimethyl-3-octene and propanone.

The isolated biomass fuel mixture was used to run a test engine as in Example 3. As shown in Table 12, the engine was taken up to 4250 rpms without pre-ignition.

TABLE 12

Standard Corrected Data for 29.92 inches Hg, 60° F. dry air — Test #178

Test: 250 RPM Step Test — Fuel Spec. Grav.: .840 — Air Sensor 6.5
Vapor Pressure: .91 — Barometric Pres.: 29.47 — Ratio: 1.00 to 1

TABLE 12-continued

Engine Type: 4-Cycle Spark Engine Displacement: 355.0 Stroke: 3.480

| Speed rpm | CBTrq lb-Ft | CBPwr Hp | FHp Hp | VE % | ME % | FA lb/hr | A1 scfm | A/F | BSFC lb/Hphr | CAT | Oil | Wat | BSAC lb/Hphr |
|---|---|---|---|---|---|---|---|---|---|---|---|---|---|
| 2000 | 326.0. | 124.1 | 17.3 | 78.2 | 87.0 | 62.8 | 148.5 | 10.9 | .54 | 77 | 191 | 167 | 5.90 |
| 2250 | 336.8 | 144.3 | 20.6 | 79.1 | 86.7 | 73.1 | 169.0 | 10.6 | .54 | 77 | 192 | 171 | 5.78 |
| 2500 | 344.5 | 164.0 | 24.1 | 79.0 | 86.4 | 80.8 | 187.5 | 10.7 | .53 | 77 | 193 | 171 | 5.64 |
| 2750 | 349.1 | 182.8 | 27.9 | 78.9 | 85.9 | 88.9 | 206.2 | 10.7 | .52 | 77 | 192 | 171 | 5.56 |
| 3000 | 360.9 | 206.2 | 31.8 | 80.2 | 85.8 | 97.5 | 228.8 | 10.8 | .51 | 77 | 195 | 170 | 5.48 |
| 3250 | 367.8 | 227.6 | 36.1 | 81.0 | 85.4 | 104.0 | 249.9 | 11.0 | .49 | 77 | 194 | 169 | 5.42 |
| 3500 | 374.1 | 249.3 | 40.7 | 82.3 | 85.1 | 111.5 | 273.4 | 11.3 | .48 | 77 | 195 | 169 | 5.41 |
| 3750 | 375.8 | 268.3 | 46.0 | 82.5 | 84.4 | 119.6 | 294.1 | 11.3 | .48 | 77 | 196 | 170 | 5.41 |
| 4000 | 372.3 | 283.5 | 51.6 | 82.8 | 83.6 | 132.4 | 314.8 | 10.9 | .30 | 77 | 198 | 170 | 5.49 |
| 4250 | 371.9 | 300.9 | 57.5 | 83.5 | 82.9 | 141.6 | 337.1 | 10.9 | .31 | 77 | 199 | 169 | 5.54 |

SF-901 Dynamometer Test Data

Test: 250 RPM Step Test Fuel Spec. Grav.: .840 Air Sensor 6.5
Vapor Pressure: .91 Barometric Pres.: 29.47 Ratio: 1.00 to 1
Engine Type: 4-Cycle Spark Engine Displacement: 355.0 Stroke: 3.480

Thermocouple Temperature

| 1 | 2 | 3 | 4 | 5 | 6 | 7 | 8 |
|---|---|---|---|---|---|---|---|
| 1250 | 1290 | 1180 | 1230 | 1110 | 1280 | 1230 | 1330 |
| 1250 | 1310 | 1190 | 1190 | 1090 | 1300 | 1250 | 1370 |
| 1280 | 1320 | 1210 | 1170 | 1100 | 1320 | 1260 | 1380 |
| 1270 | 1320 | 1240 | 1170 | 1120 | 1340 | 1250 | 1380 |
| 1270 | 1330 | 1260 | 1190 | 1130 | 1360 | 1260 | 1400 |
| 1250 | 1350 | 1280 | 1220 | 1150 | 1380 | 1270 | 1410 |
| 1140 | 1360 | 1280 | 1260 | 1180 | 1400 | 1290 | 1420 |
| 1270 | 1370 | 1290 | 1290 | 1210 | 1420 | 1310 | 1450 |
| 1250 | 1390 | 1290 | 1320 | 1240 | 1450 | 1300 | 1470 |
| 1370 | 1380 | 1300 | 1340 | 1270 | 1470 | 1310 | 1490 |

The present invention has been described in terms of particular embodiments found by the inventors to comprise preferred modes of practice of the invention. It will be appreciated by those of skill in the art that in light of the present disclosure modifications and changes can be made in the particular embodiments exemplified without departing from the intended scope of the invention. For example, numerous modifications of reaction conditions could be employed to vary product composition, including use of non-traditional catalysts, combinations of low temperatures and high pressures, oxygen or hydrogen donors added to the feedstock and the like. All such modifications are intended to be included within the scope of the claims.

REFERENCES

The references cited within the text are incorporated by reference to the extent they supplement, explain, provide background for or teach methodology, techniques and/or compositions employed herein.

1. Haag, W. O., Rodewald, P. G. and Weisz, P. B., U.S. Pat. No. 4,300,009, Nov. 10, 1981.
1. Rudolph, T. W. and Thomas, J. J., Biomass 16, 33 (1988).
2. Schwartz, S. E., Lubr. Engng. (ASLE) 42, 292–299 (1986).
3. Whitaker, M. C., U.S. Pat. No. 1,405,250, Feb. 7, 1922.
4. Whitworth, R. D., U.S. Pat. No. 4,818,250, Apr. 4, 1989.
5. Whitworth, R. D., U.S. Pat. No. 4,915,707, Apr. 10, 1990.
6. Wilson, E. J. A., U.S. Pat. No. 5,004,850, Apr. 2, (1991).
7. Zuidema, H. H., U.S. Pat. No. 2,402,863, Jun. 25, 1946.

We claim:

1. A process for the preparation of a biomass fuel having an octane number of at least 95, comprising the steps:

obtaining a feedstock that includes one or more terpenoids;

converting the feedstock in a liquid phase at a temperature between about 80° C. to about 150° C. at ambient pressure in the presence of a matrix-supported single metal catalyst selected from a group consisting essentially of platinum, palladium or rhodium for a period of time sufficient to provide a hydrocarbon fuel mixture having at least 70% monocyclic aromatic hydrocarbon content wherein said hydrocarbon mixture contains up to 3% of volatile hydrocarbons with vapor pressures of at least 0.17 psi at 100° C. and contains less than 2% of aliphatic olefins and polycyclic aromatic hydrocarbon components.

2. The process of claim 1 wherein the biomass feed stock is obtained from citrus fruits or oils, seeds of plants, or leaves of plants.

3. The process of claim 1 wherein the terpenoid comprises a monocyclic terpene.

4. The process of claim 3 wherein the monocyclic terpene comprises dl-limonene, d-limonene or l-limonene.

5. The process of claim 1 wherein the biomass feedstock is converted at a temperature between 90°–210° C.

6. The process of claim 2 wherein the biomass feedstock is obtained from the fruits, seeds or leaves by solvent extraction or mechanical pressing.

7. The process of claim 1 wherein the biomass feedstock, said feedstock comprising limonene, is converted at 90°–120° C. over a palladium catalyst to provide a hydrocarbon mixture comprising at least 80% monocyclic aromatic compounds.

8. The process of claim 7 further comprising reacting in an inert atmosphere.

9. The process of claim 7 wherein the palladium catalyst is 1% palladium on carbon added at about 10 g/600 ml of limonene feedstock.

10. The process of claim 7 wherein the hydrocarbon mixture comprises 1-methyl-4-(1-methylethyl)benzene and 1-methyl-4-(1-methylethyl)cyclohexane.

11. The process of claim 10 wherein the hydrocarbon mixture further comprises cis-and trans-1-methyl-4-(1-methylethyl)cyclohexane.

12. The process of claim 1 further comprising irradiating the feedstock with ultraviolet light.

13. The process of claim 12 wherein the feedstock is simultaneously irradiated and catalytically converted.

14. The process of claim 13 wherein the feedstock is irradiated at a wavelength within the range of 230–350 nm.

15. The process of claim 13 wherein the feedstock is irradiated in a hydrogen atmosphere.

16. The process of claim 13 wherein the feedstock is irradiated in the presence of 5% Pd on activated carbon.

17. The process of claim 7 wherein the limonene feedstock is irradiated in the presence of hydrogen and a catalyst for a period of time sufficient to produce a hydrocarbon mixture, said mixture comprising major components cis- and trans-1-methyl-4-(1-methylethyl)-cyclohexane, 1-methyl-4-(1-methylethylidene)cyclohexane) and 1-methyl-1-(4-methylethyl)benzene.

18. The process of claim 17, wherein said hydrocarbon mixture further comprises 3,3,5-trimethylheptane, 2,6,10,15-tetramethylheptadecane, 3-methylhexadecane, 3-methyl nonane and $\beta$-4-dimethyl cyclohexane ethanol.

19. A process for converting biomass to a hydrocarbon fuel, comprising the steps:

obtaining the biomass from a plant oil, seed, leaves or fruit wherein the biomass is provided from chemical or mechanical extraction; and converting the biomass in a liquid phase to the hydrocarbon fuel at 365°–370° C. in the presence of a palladium or platinum metal on carbon catalyst at a pressure of between 800 psi and 2000 psi for a time sufficient to form a hydrocarbon fuel mixture consisting essentially of cis- and trans-1-methyl-4-(1-methylethyl)cyclohexane and up to 3% of low molecular weight saturated hydrocarbons with vapor pressures greater than about 0.17 psi at 100° C. wherein the hydrocarbon fuel mixture is substantially fee of olefinic and aromatic hydrocarbons.

20. The process of claim 19 wherein the hydrocarbon mixture comprises cis and trans-1-methyl-4-(1-methylethyl) cyclohexane.

21. The process of claim 20 wherein the hydrocarbon mixture further comprises 3,3,5-trimethyl heptane, 1(1,5-dimethylhexyl)-4-methyl cyclohexane, 1S,3R-(+)-(H)m-menthane, 1S,3S-(H)m-menthane and cyclohexanepropionic acid.

22. A hydrocarbon composition capable of boosting octane in gasoline fuels for internal combustion engines, comprising hydrocarbons having formulae $C_{10}H_{14}$, $C_{10}H_{18}$, and $C_{10}H_{20}$ with a ratio of about 80:17:3 wherein the $C_{10}H_{14}$ is 1-methyl-4-(1-methylethyl)benzene, $C_{10}H_{18}$ is 1-methyl-4-(1-methylethyl)cyclohexane and $C_{10}H_{20}$ is a mixture of cis- and trans-1-methyl-4-(1-methyl)cyclohexane.

23. A method of increasing octane and reducing emissions in an internal combustion engine comprising blending a biomass fuel produced by the process of claim 1 with a fossil fuel.

24. The method of claim 23 wherein the biomass fuel comprises up to 100% (v/v) of the fossil fuel.

25. The method of claim 24 wherein the fossil fuel is gasoline.

26. A method of running a fossil-fuel engine without modification of said engine, comprising the steps:

obtaining a biomass feedstock that includes one or more terpenes;

converting the feedstock to a hydrocarbon mixture according to claim 1; and supplying said hydrocarbon mixture to an engine in an amount sufficient to run said engine.

27. The method of claim 26 wherein the monocyclic aromatic compound is 1-methyl-4-(1-methylethyl)benzene.

28. A biomass fuel produced by the method of claim 1 or claim 17.

29. A hydrocarbon composition biomass fuel having an octane rating of at least 95 consisting essentially of 1-methyl-4-(1-methylethyl)benzene, menthene and aliphatic or alicyclic hydrocarbons from a group consisting essentially of 3,3,5-trimethylheptane, 4-methyl-1,3-pentadiene and 1-methyl-4-(1-methylethyl)cyclohexane. wherein the aliphatic hydrocarbons are present at about 1–3% by volume and the 1-methyl-4-(1-methylethyl-)benzene is at least about 70% by volume.

* * * * *